US006993932B2

(12) United States Patent
Lee et al.

(10) Patent No.: US 6,993,932 B2
(45) Date of Patent: Feb. 7, 2006

(54) REFRIGERANT CYCLE SYSTEM

(75) Inventors: Yong Taek Lee, Seoul (KR); Hyoung Seo Choi, Suwon-Si (KR); Hyun Il Roh, Suwon-Si (KR); Moo Gyo Seo, Suwon-Si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 10/890,239

(22) Filed: Jul. 14, 2004

(65) Prior Publication Data

US 2005/0138957 A1 Jun. 30, 2005

(30) Foreign Application Priority Data

Dec. 26, 2003 (KR) ..... 10-2003-0097626

(51) Int. Cl.
*F25B 43/02* (2006.01)

(52) U.S. Cl. ..... 62/470; 62/471; 62/503

(58) Field of Classification Search ..... 62/470, 62/503, 509, 510, 512, 471
See application file for complete search history.

(56) References Cited

U.S. PATENT DOCUMENTS

| | | | | |
|---|---|---|---|---|
| 5,347,817 | A * | 9/1994 | Kim | 62/471 |
| 5,850,743 | A * | 12/1998 | Dreiman et al. | 62/503 |
| 5,868,001 | A * | 2/1999 | Shoulders | 62/503 |
| 5,873,261 | A * | 2/1999 | Bae | 62/503 |
| 6,092,284 | A * | 7/2000 | Dreiman et al. | 29/890.02 |
| 6,178,771 | B1 * | 1/2001 | Yun | 62/503 |
| 6,202,437 | B1 * | 3/2001 | Yun | 62/503 |
| 6,220,050 | B1 * | 4/2001 | Cooksey | 62/503 |
| 6,263,694 | B1 * | 7/2001 | Boyko | 62/468 |
| 6,385,995 | B1 * | 5/2002 | Komatsubara et al. | 62/505 |
| 6,539,745 | B1 * | 4/2003 | Harmer et al. | 62/503 |
| 6,807,817 | B2 * | 10/2004 | Lee et al. | 62/175 |
| 2004/0107709 | A1 * | 6/2004 | Lee et al. | 62/175 |

FOREIGN PATENT DOCUMENTS

| | | | |
|---|---|---|---|
| JP | 4-103972 A | * | 4/1992 |
| JP | 07-139854 A | | 6/1995 |
| JP | 10-26443 A | * | 1/1998 |
| JP | 10-37883 A | * | 2/1998 |

* cited by examiner

*Primary Examiner*—Mohammad M. Ali
(74) *Attorney, Agent, or Firm*—Sughrue Mion, PLLC

(57) ABSTRACT

A refrigerant cycle system in which the arrangement of a connecting pipe for connection between a compressor and an accumulator is improved effectively to recover oil collected in the accumulator to the compressor. The accumulator is installed to be separate from the compressor. A connecting pipe is arranged between the compressor and the accumulator to feed a refrigerant gas separated in the accumulator to the compressor. An oil recovery hole is provided at an inlet portion of the connecting pipe received in the accumulator such that it is arranged at a level higher than a highest level portion of the connecting pipe located outside of the accumulator. A second accumulator may be connected between the connecting pipe and the compressor while being directly installed at the compressor. In this case, the connecting pipe has an outlet portion connected to the second accumulator.

3 Claims, 4 Drawing Sheets

REFRIGERANT CYCLE SYSTEM

CROSS-REFERENCE TO RELATED APPLICATION

This application claims the benefit of Korean Patent Application No. 2003-97626, filed on Dec. 26, 2003 in the Korean Intellectual Property Office, the disclosure of which is incorporated herein by reference.

BACKGROUND OF THE INVENTION

1. Field of the Invention

An apparatus consistent with the present invention relates to a refrigerant cycle system and, more particularly, to a refrigerant cycle system in which the arrangement of a connecting pipe for connection between a compressor and an accumulator is improved effectively to recover oil collected in the accumulator to the compressor.

2. Description of the Related Art

Refrigerant cycle systems cool or heat air in confined spaces by utilizing phase change of a refrigerant circulating a closed refrigerant circuit including a compressor, a condenser, an expansion unit, and an evaporator, which are appropriately connected to one another by connecting pipes.

The compressor compresses a low temperature and low pressure refrigerant gas to a high temperature and high pressure gas state. The condenser condenses the high temperature and high pressure refrigerant gas discharged from the compressor to a high temperature and high pressure liquid state. The expansion unit expands the high temperature and high pressure refrigerant liquid emerging from the condenser, thereby changing the refrigerant liquid to a low temperature and low pressure liquid state (of course, a small part of the refrigerant liquid may be changed to a gas state). The low temperature and low pressure refrigerant liquid absorbs heat from air in a confined space while passing through the evaporator, so that it is changed to a high temperature and low pressure gas state. The resultant refrigerant is then introduced into the compressor in order to repeat the above processes.

As the refrigerant repeatedly circulates the closed refrigerant circuit of the refrigerant cycle system, the evaporator cools the air in the confined space, thereby lowering the temperature of the confined space. Meanwhile, the condenser emits heat therearound, so that the temperature of ambient air around the condenser increases. Thus, the refrigerant cycle system is used as a refrigerator or a cooling/heating apparatus, by use of heat absorption caused by evaporation and heat emission caused by condensation.

Meanwhile, the refrigerant is typically incompletely changed to a gas state while passing though the evaporator. To this end, an accumulator is arranged between the evaporator and the compressor in order to separate a liquid portion from the refrigerant emerging from the evaporator, so that only the refrigerant gas is introduced into the compressor.

The accumulator may be attached to the compressor so that it is integral with the compressor. Alternatively, it may be separate from the compressor. In the latter case, the accumulator may be connected to the compressor by a connecting pipe. The refrigerant cycle system may be configured to include a plurality of compressors so that it has a variable capacity.

In a conventional refrigerant cycle system having the above mentioned arrangement in which the accumulator is separate from the compressor, the refrigerant gas emerging from the accumulator is fed to the compressor via the connecting pipe. This connecting pipe has an inlet portion received in the accumulator, and an outlet portion received in a lower end portion of the compressor. The portion of the connecting pipe between the inlet and outlet portions has an inverted U shape while being arranged between the accumulator and the compressor.

Meanwhile, oil adapted to lubricate rotating parts of the compressor may partially be included in the refrigerant emerging from the compressor. After circulating the closed refrigerant circuit of the refrigerant cycle system, the oil included in the refrigerant is collected in the accumulator. In order to feed the collected oil to the compressor, an oil recovery hole is provided at the inlet portion of the connecting pipe received in the accumulator.

In the conventional refrigerant cycle system, however, there is a possibility that oil may not be effectively recovered into the compressor because the oil recovery hole is arranged at a level lower than a highest level portion of the connecting pipe. The oil collected in the accumulator is introduced into the inlet portion of the connecting pipe through the oil recovery hole, and then fed to the compressor via the connecting pipe, along with the refrigerant gas introduced into the inlet portion of the connecting pipe. However, the oil is ineffectively recovered into the compressor because the flow rate of the refrigerant gas is relatively low due to the fact that the connecting pipe has a large diameter, as compared to the high viscosity of the oil, and because of the structure in which the oil recovery hole is arranged at a level lower than the highest level portion of the connecting pipe located outside of the accumulator. As a result, there may be a phenomenon that the amount of the lubricating oil in the compressor is insufficient after prolonged use.

In particular, such an oil shortage phenomenon may be severe in a refrigerant cycle system including a common accumulator and a plurality of compressors to allow variable capacity operation. In such a refrigerant cycle system, there may also be a problem in that recovery of oil may be achieved in only one of the compressors. That is, the collected oil may be ineffectively recovered to the other compressor.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

Accordingly, an aspect of the invention is to provide a refrigerant cycle system in which the arrangement of a connecting pipe for connection between an accumulator and a compressor is improved effectively to recover oil collected in the accumulator to the compressor.

In accordance with one aspect, the present invention provides a refrigerant cycle system comprising: a compressor; an accumulator installed to be separate from the compressor; a connecting pipe arranged between the compressor and the accumulator to feed a refrigerant gas separated in the accumulator to the compressor; and an oil recovery hole provided at an inlet portion of the connecting pipe received in the accumulator, the oil recovery hole being arranged at a level higher than a highest level portion of the connecting pipe located outside of the accumulator.

A refrigerant pipe adapted to circulate a refrigerant may be connected to a top of the accumulator. The inlet portion of the connecting pipe may extend upwardly from a bottom of the accumulator. The accumulator may collect, in a portion thereof below an upper end of the inlet portion, a refrigerant gas and oil separated from the refrigerant introduced therein via the refrigerant pipe.

The refrigerant cycle system may further comprise a second accumulator connected between the connecting pipe and the compressor while being directly installed at the compressor. In this case, the connecting pipe has an outlet portion connected to the second accumulator.

In accordance with another aspect, the present invention provides a refrigerant cycle system comprising: a plurality of compressors; a common accumulator adapted to feed a refrigerant gas separated therein to the compressors, the common accumulator being installed to be separate from the compressors; a plurality of connecting pipes each arranged between an associated one of the compressors and the common accumulator to feed the refrigerant gas separated in the common accumulator to the associated compressor; and an oil recovery hole provided at an inlet portion of each connecting pipe received in the common accumulator, the oil recovery hole being arranged at a level higher than a highest level portion of the connecting pipe located outside of the accumulator.

BRIEF DESCRIPTION OF THE DRAWINGS

The above aspects, and other features and advantages of the present invention will become more apparent after reading the following detailed description of the exemplary embodiments when taken in conjunction with the drawings, in which.

DETAILED DESCRIPTION OF THE ILLUSTRATIVE, NON-LIMITING EMBODIMENTS OF THE INVENTION

Illustrative, non-limiting embodiments of the present invention will now be described in detail with reference to the accompanying drawings.

Figure 1:
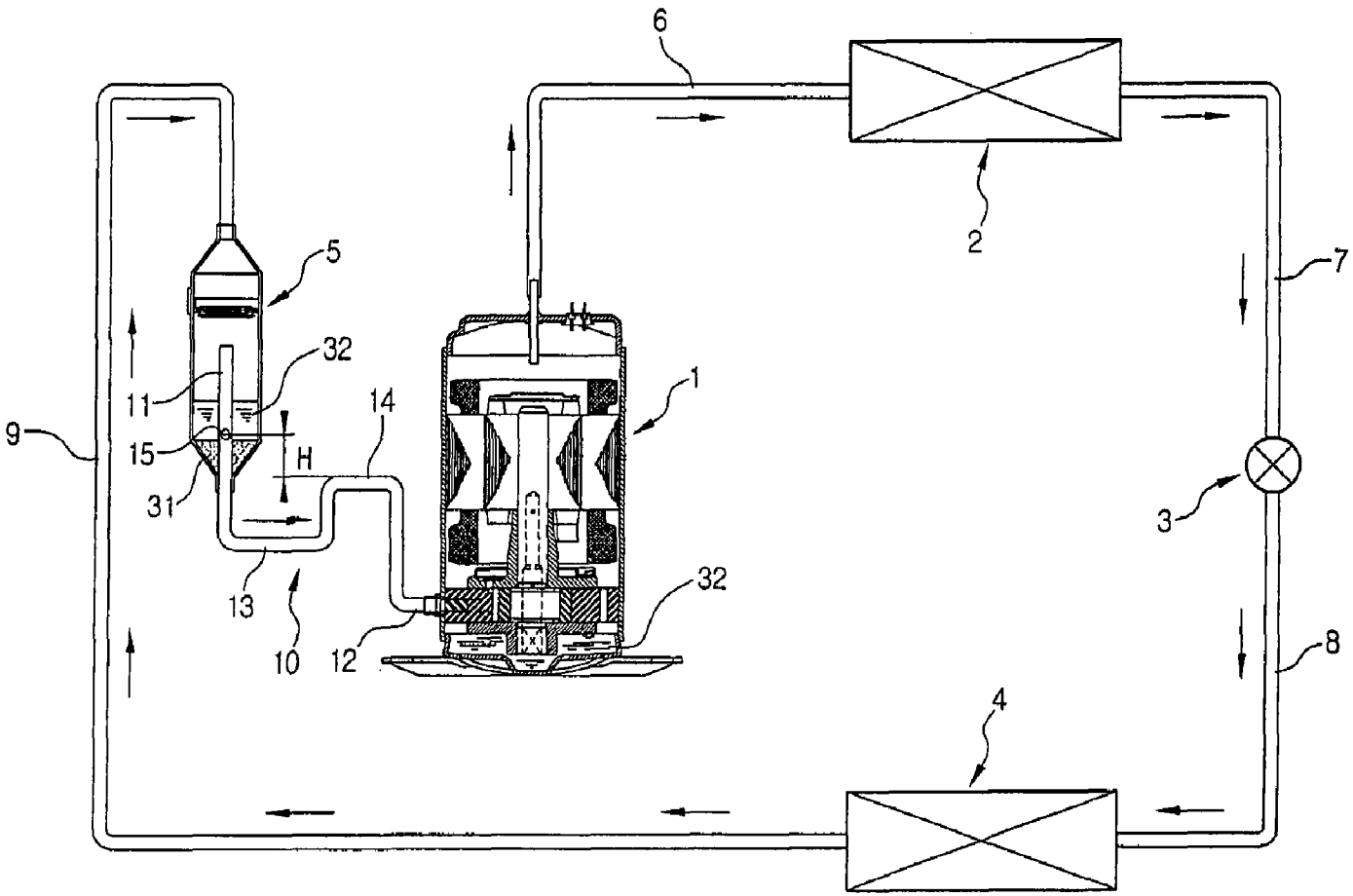
FIG. 1 is a refrigerant circuit diagram illustrating the configuration of a refrigerant cycle system according to a first embodiment of the present invention.

FIG. 1 is a refrigerant circuit diagram illustrating the configuration of a refrigerant cycle system according to a first embodiment of the present invention.

As shown in FIG. 1, the refrigerant cycle system according to the first embodiment of the present invention includes a compressor 1 for compressing a refrigerant to a high temperature and high pressure gas state, and a condenser 2 for condensing the high temperature and high pressure refrigerant gas discharged from the compressor 1 to a high temperature and high pressure liquid state. The refrigerant cycle system also includes an expansion unit 3 for expanding the high temperature and high pressure refrigerant liquid emerging from the condenser 2, thereby changing the refrigerant liquid to a low temperature and low pressure liquid state (of course, a small part of the refrigerant liquid may be changed to a gas state), and an evaporator 4 for conducting heat exchange with ambient air, using the low temperature and low pressure refrigerant liquid passing therethrough after emerging from the expansion unit 3, thereby changing the refrigerant liquid to a low temperature and low pressure gas state.

The low temperature and low pressure refrigerant gas emerging from the evaporator 4 contains a small amount of refrigerant liquid. In order to introduce only the refrigerant gas into the compressor 1, an accumulator adapted to separate the refrigerant liquid from the refrigerant gas is arranged between the evaporator 4 and the compressor 1.

The compressor 1 and condenser 2 are connected by a first refrigerant pipe 6, whereas the condenser 2 and expansion unit 3 are connected by a second refrigerant pipe 7. A third refrigerant pipe 8 connects the expansion unit 3 and evaporator 4. The evaporator 4 is also connected with the accumulator 5 by a fourth refrigerant pipe 9. The accumulator 5 is also connected to the compressor 1 by a connecting pipe 10.

Thus, the compressor 1, condenser 2, expansion unit 3, evaporator 4, and accumulator 5 are connected to one another by the first through fourth refrigerant pipes 6 to 9 and connecting pipe 10 to form a closed refrigerant circuit. As the refrigerant repeatedly circulates through these elements of the closed refrigerant circuit, its temperature and state are repeatedly changed.

During the circulation of the refrigerant, a heat emission effect is generated at the condenser 2 in accordance with a condensing operation of the condenser 2, whereas a heat absorption effect is generated at the evaporator 4 in accordance with an evaporating operation of the evaporator 4. Using these heat emission and absorption effects, it is possible to cool or heat confined spaces.

The accumulator 5 is separate from the compressor 1, which may be of a rotary type. The accumulator 5 is arranged such that its lower end is positioned at a level higher than the bottom of the compressor 1.

The connecting pipe 10 adapted to connect the accumulator 5 and compressor 1 has a certain length. The connecting pipe 10 has an inlet portion 11 received in the accumulator 5 to extend upwardly through the bottom of the accumulator 5, and an inlet portion 12 connected to a lower portion of the compressor 1.

A portion of the connecting pipe 10 between the inlet and outlet portions 11 and 12, that is, an intermediate portion 13, is arranged between the bottom of the accumulator 5 and the lower end portion of the compressor 1. In order to prevent the connecting pipe 10 from being damaged due to vibrations caused by operation of the compressor 1, the intermediate portion 13 has a sufficient length while having an upwardly bent structure, that is, an inverted U-shaped bent portion 14.

The refrigerant liquid contained in the refrigerant gas introduced into the accumulator via the fourth refrigerant pipe 9 connected to an upper end of the accumulator, that is, refrigerant liquid 31, is separated from the refrigerant gas, and then collected in the lower portion of the accumulator 5. At this time, a portion of oil 32 stored in the lower portion of the compressor 1 to lubricate and cool moving parts of the compressor 1 may also be collected in the lower portion of the accumulator 5, after being discharged from the compressor, along with the refrigerant, and then circulating through the closed refrigerant circuit.

The oil 32 collected in the accumulator 5 is again fed to the compressor 1, so as to perform lubricating and cooling functions in the compressor 1. To this end, an oil recovery hole 15 is provided at the inlet portion 11 of the connecting pipe 10 received in the accumulator 5 to upwardly extend through the bottom of the accumulator 5.

The oil recovery hole 15 is arranged at a level flush with a highest level portion of the connecting pipe 10 located outside of the accumulator 5, that is, the upper end of the bent portion 14, or at a level higher than the upper end of the bent portion 14 by a certain height H, so that the oil 32 collected in the lower portion of the accumulator 5 can be effectively discharged from the accumulator 5, and introduced into the compressor 1, along with the refrigerant gas flowing from the accumulator 5 to the compressor 1 via the connecting pipe 10.

That is, in accordance with a flow of refrigerant gas, the oil 32 collected in the accumulator 5 is effectively discharged from the accumulator 5 through the oil recovery hole 15, and then recovered into the compressor 1 via the connecting pipe 10 because the highest level of the connecting pipe 10 outside of the accumulator 5 is lower than the level of the oil recovery hole 15.

Figure 2:
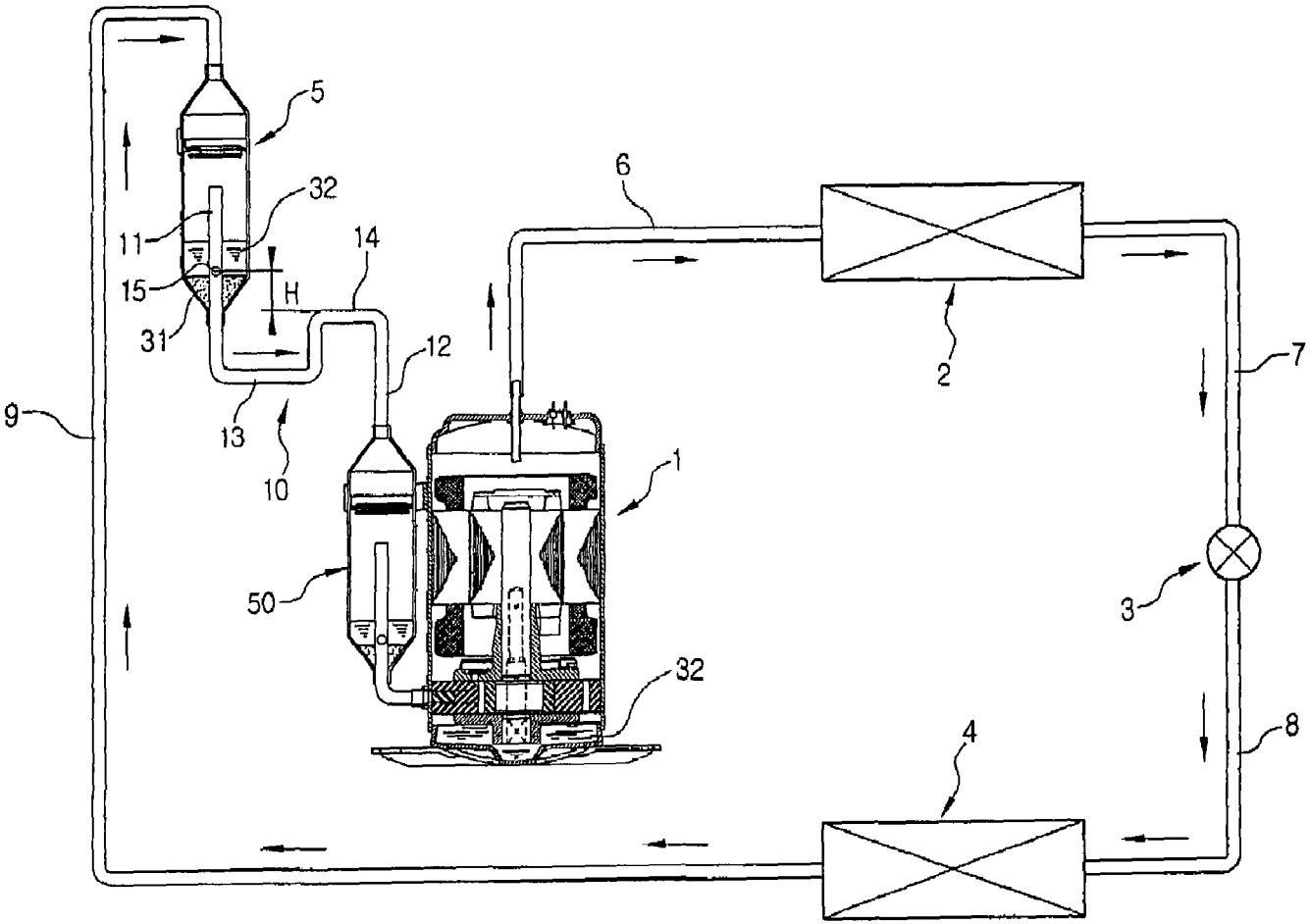
FIG. 2 is a refrigerant circuit diagram illustrating the configuration of a refrigerant cycle system according to a second embodiment of the present invention.

FIG. 2 is a refrigerant circuit diagram illustrating the configuration of a refrigerant cycle system according to a second embodiment of the present invention.

As shown in FIG. 2, the refrigerant cycle system according to the second embodiment of the present invention has the same configuration as that of the first embodiment, except that it further includes a second accumulator 50 directly attached to the compressor 1, in addition to the first accumulator 5. In this refrigerant cycle system, accordingly, the arrangement of the connecting pipe 10 is identical to that of the first embodiment.

In this refrigerant cycle system, the refrigerant gas and oil 32 emerging from the first accumulator 5 pass through the second accumulator 50 before they are introduced into the compressor 1, so as to separate the refrigerant liquid contained in the refrigerant gas and oil 32. Since refrigerant liquid separation is carried out one more time, it is possible more reliably to achieve the introduction of only the refrigerant gas and oil into the compressor 1.

Figure 3:
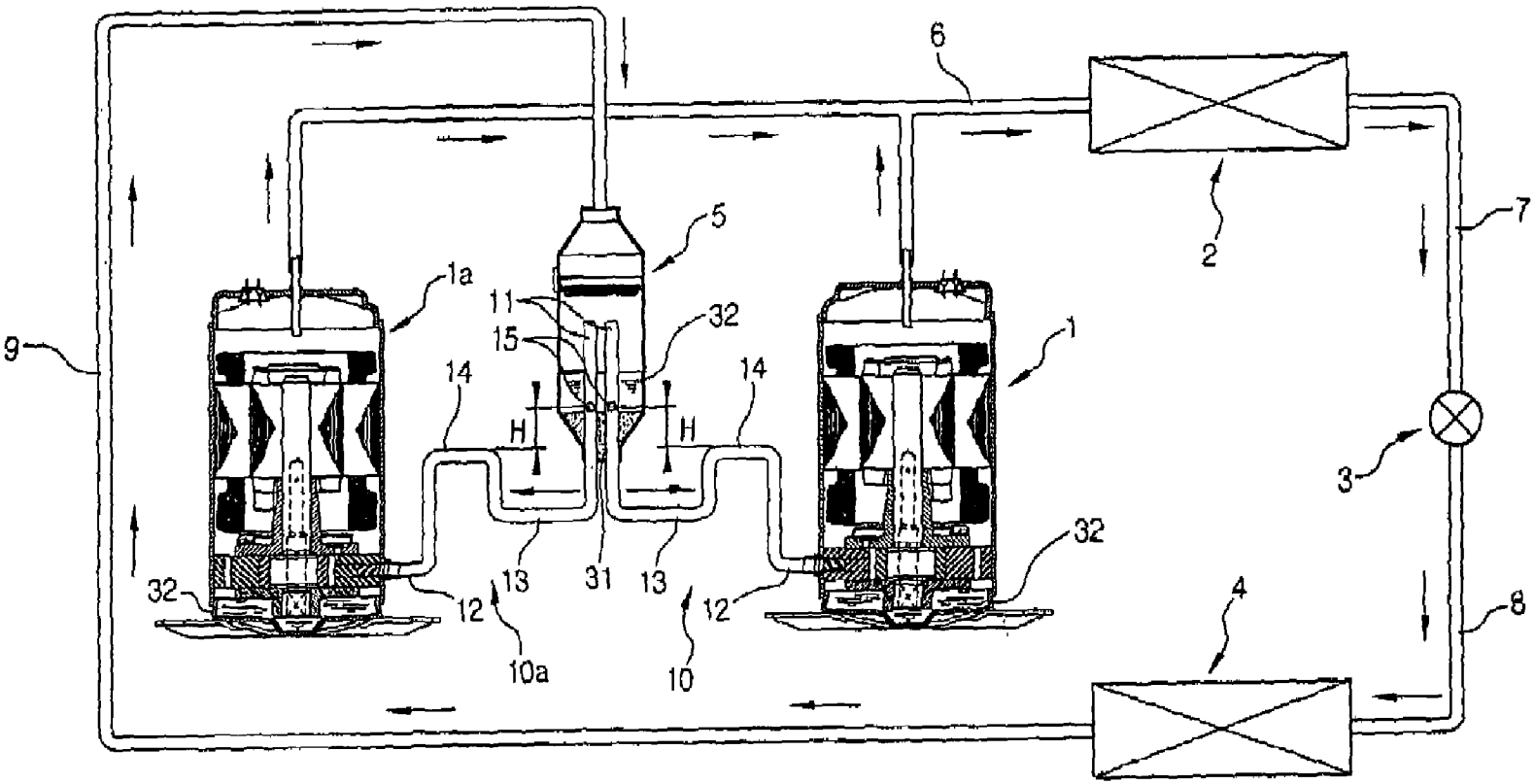
FIG. 3 is a refrigerant circuit diagram illustrating the configuration of a refrigerant cycle system according to a third embodiment of the present invention.

FIG. 3 is a refrigerant circuit diagram illustrating the configuration of a refrigerant cycle system according to a third embodiment of the present invention.

As shown in FIG. 3, the refrigerant cycle system according to the third embodiment of the present invention further includes, in addition to the configuration of the first embodiment, a second compressor 1*a* arranged in parallel to the first compressor 1 to receive a refrigerant gas from a common accumulator, that is, the accumulator 5. In this case, accordingly, the refrigerant cycle system includes a first connecting pipe, that is, the connecting pipe 10, adapted to connect the common accumulator 5 and the first compressor 1, and a second connecting pipe 10*a* adapted to connect the common accumulator 5 and the second compressor 1*a*. The arrangements of the first and second connecting pipes 10 and 10*a* are identical to that of the first embodiment.

In accordance with the above arrangements, the oil 32 collected in the common accumulator 5 is uniformly distributed into the first and second compressors 1 and 1*a*, along with refrigerant gas. Of course, the first and second compressors 1 and 1*a* can receive the oil 32 as long as they are in operation. For example, under the condition in which only one of the first and second compressors 1 and 1*a* is in operation, the refrigerant gas and oil can be fed to only the compressor in operation.

In the case of a refrigerant cycle system in which a plurality of compressors are arranged in parallel, as described above, it is possible to vary the cooling or heating ability of the system, and thus, to vary the capacity of the system in accordance with the difference between an indoor temperature and an outdoor temperature. Where such a refrigerant cycle system is applied to the case in which a plurality of indoor units are installed in a plurality of confined spaces, it is possible efficiently to operate the system by varying the cooling or heating ability of the system.

Where the connecting pipes having an arrangement according to the present invention are applied to the case in which a plurality of compressors are arranged in parallel, it is possible effectively to recover oil, irrespective of the condition in which one or all of the compressors operate.

Figure 4:
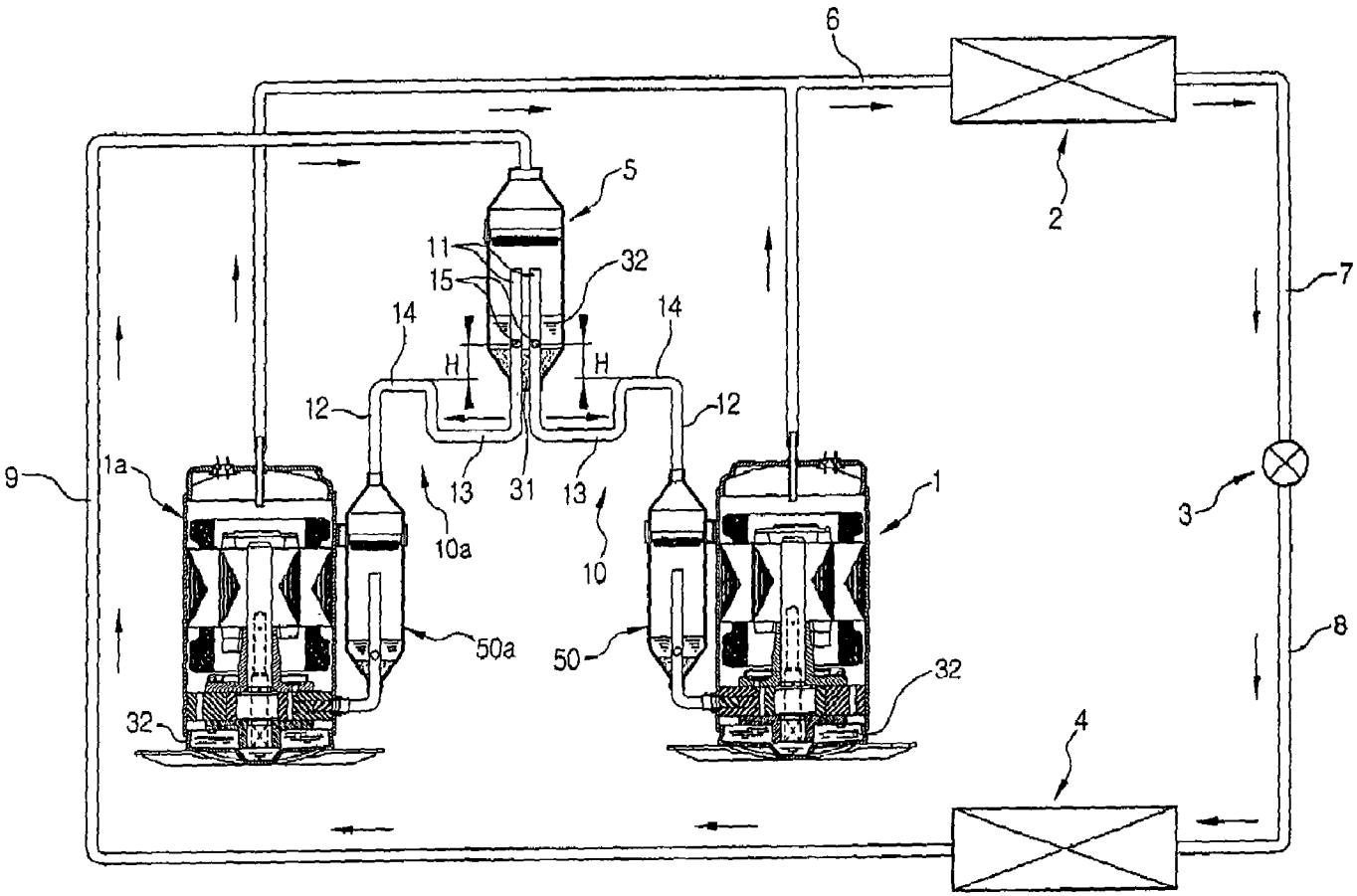
FIG. 4 is a refrigerant circuit diagram illustrating the configuration of a refrigerant cycle system according to a fourth embodiment of the present invention.

FIG. 4 is a refrigerant circuit diagram illustrating the configuration of a refrigerant cycle system according to a fourth embodiment of the present invention.

As shown in FIG. 4, the refrigerant cycle system according to the fourth embodiment of the present invention. This refrigerant cycle system has the same configuration as that of the third embodiment in that it includes the first and second compressor 1 and 1*a* arranged in parallel, and the common accumulator 5 installed to be separate from the first and second compressors 1 and 1*a*. In addition to this configuration, the refrigerant cycle system of the fourth embodiment further includes second and third accumulators 50 and 50*a* respectively directly attached to the first and second compressors 1 and 1*a*.

In the refrigerant cycle system of the fourth embodiment, accordingly, it is possible to vary the capacity of the system, effectively to recover the oil 32 by the first and second connecting pipes 10 and 10*a*, and to achieve separation of refrigerant liquid one more time by the second and third accumulators 50 and 50*a*, and thus, more reliably to achieve the introduction of only the refrigerant gas and oil 32 into the compressor 1.

As apparent from the above description, the present invention provides a refrigerant cycle system having an arrangement in which an accumulator is installed to be separate from a compressor and a connecting pipe is arranged between the compressor and the accumulator. Moreover, the highest level of a portion of the connecting pipe located outside of the accumulator is lower than the level of an oil recovery hole provided at an inlet portion of the connecting pipe received in the accumulator. In accordance with the arrangement, it is possible effectively to recover oil connected in the accumulator to the compressor. Thus, the compressor can operate effectively.

Although the exemplary embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerant cycle system comprising:

a plurality of compressors;

a common accumulator adapted to feed a refrigerant gas separated therein to the compressors, the common accumulator being installed to be separate from the compressors;

a plurality of connecting pipes each arranged between an associated one of the compressors and the common accumulator to feed the refrigerant gas separated in the common accumulator to the associated compressor; and an oil recovery hole provided at an inlet portion of each connecting pipe received in the common accumulator, the oil recovery hole being arranged at a level higher than a highest level portion of the connecting pipe located outside of the accumulator.

2. The refrigerant cycle system according to claim 1, further comprising:

a refrigerant pipe connected to a top of the common accumulator, and adapted to circulate a refrigerant, wherein the inlet portion of each connecting pipe extends upwardly from a bottom of the common accumulator, wherein the common accumulator collects, in a portion thereof below an upper end of the inlet portion of each connecting pipe, a refrigerant gas and oil separated from the refrigerant introduced therein via the refrigerant pipe.

3. The refrigerant cycle system according to claim 1, further comprising:

a plurality of second accumulators each connected between an associated one of the connecting pipes and an associated one of the compressors while being directly installed at the associated compressor, wherein each connecting pipe has an outlet portion connected to the associated second accumulator.

* * * * *